US007213510B1

(12) United States Patent
Bagwell

(10) Patent No.: US 7,213,510 B1
(45) Date of Patent: May 8, 2007

(54) COMPACTING METHOD AND APPARATUS

(76) Inventor: Brian Bagwell, P.O. Box 1025, Darlington, SC (US) 29532

( * ) Notice: Subject to any disclaimer, the term of this patent is extended or adjusted under 35 U.S.C. 154(b) by 0 days.

(21) Appl. No.: 11/394,969

(22) Filed: Mar. 31, 2006

(51) Int. Cl.
*B30B 9/04* (2006.01)
*B30B 15/06* (2006.01)

(52) U.S. Cl. ..... 100/35; 100/100; 100/229 A; 100/265; 100/295

(58) Field of Classification Search ..... 100/35, 100/100, 214, 226, 229 A, 265, 295, 299
See application file for complete search history.

(56) References Cited

U.S. PATENT DOCUMENTS

| | | | | |
|---|---|---|---|---|
| 257,457 | A | | 5/1882 | Alexander |
| 325,102 | A | | 8/1885 | Marshall |
| 818,796 | A | | 4/1906 | Spengler |
| 2,579,176 | A | | 12/1951 | Dalton |
| 2,605,697 | A | | 8/1952 | Bell et al. |
| 2,646,225 | A | | 7/1953 | Te Desco |
| 2,800,234 | A | | 7/1957 | Herpich et al. |
| 2,951,600 | A | | 9/1960 | Dempster |
| 3,211,309 | A | | 10/1965 | Shubin |
| 3,242,851 | A | * | 3/1966 | Brawley et al. ..... 100/34 |
| 3,827,587 | A | * | 8/1974 | Liberman et al. ..... 414/420 |
| 3,901,394 | A | | 8/1975 | Bowles |
| 3,935,812 | A | | 2/1976 | Karls et al. |
| 3,968,891 | A | | 7/1976 | Perkins |
| 4,004,703 | A | | 1/1977 | Johnson, Jr. |
| 4,007,678 | A | | 2/1977 | Gustavsson et al. |
| 4,156,386 | A | | 5/1979 | Gould |
| 4,273,037 | A | | 6/1981 | Ruebesam |
| 4,393,767 | A | | 7/1983 | Dutfield |
| 5,193,453 | A | | 3/1993 | Lundy |
| 5,341,731 | A | | 8/1994 | Grizzard et al. |
| 5,517,907 | A | | 5/1996 | Fox |
| 5,619,915 | A | | 4/1997 | Wagner et al. |
| 5,692,583 | A | * | 12/1997 | Reed et al. ..... 187/237 |
| 5,752,439 | A | | 5/1998 | LaMora |
| 6,061,933 | A | | 5/2000 | Rogge |

FOREIGN PATENT DOCUMENTS

| | | | |
|---|---|---|---|
| JP | 11192593 | A | 7/1999 |
| JP | 2004042941 | A | 2/2004 |
| NL | 9201663 | A | 4/1994 |

* cited by examiner

*Primary Examiner*—Lowell A. Larson
*Assistant Examiner*—Jimmy Nguyen
(74) *Attorney, Agent, or Firm*—Sara A. Centioni; Michael A. Mann; Nexsen Pruet, LLC

(57) ABSTRACT

A compaction system and method including a forklift apparatus that engages a compaction weight. The compaction weight is lifted by the forklift apparatus over the open top of a roll off container. Thereafter, the weight is lowered into the roll off container to compact the refuse within the roll off container.

23 Claims, 10 Drawing Sheets

COMPACTING METHOD AND APPARATUS

CROSS REFERENCE TO RELATED APPLICATIONS

The present invention claims the benefit of priority of U.S. application Ser. No. 10/816,058, filed Apr. 1, 2004, now abandoned.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

The present invention relates to a compacting method and apparatus, and, in particular, a compacting method and apparatus employing the use of a forklift.

A major concern of metropolitan areas is refuse collection. Typically, industries within these areas incur significant expenses to collect and remove refuse. Currently, there are three main forms of refuse collection systems. One involves the use of roll-off containers, whereby the containers themselves are transported offsite and emptied of refuse at a disposal site. The second involves the use of front-end load containers, whereby the containers full of refuse are emptied onsite by a refuse collection vehicle and thereafter transported to a disposal site. And third involves a hydraulic compactor or packing ram which compacts refuse horizontally into an enclosed container and the container is transported to a disposal site whereby it is emptied and returned. Because of the hassle and inconvenience involved in refuse collection, these refuse collection systems are typically operated by independent contractors that will charge a fee based on various parameters, including the amount of trips that must be made either onsite to empty the front-end load containers or to transport the roll off or enclosed containers to the disposal sites.

In the case that a refuse collection fee is directly related to the amount of pickups and the amount of filled roll off containers being picked up, it becomes desirable to pack as much refuse as possible into the containers. Accordingly, a device sometimes used in refuse collection systems is a hydraulic packing ram. Although packing rams generally function to compact the refuse in containers, these rams tend to be very expensive and must be permanently installed and occupy valuable space. Additionally, packing rams require maintenance and electric service.

Accordingly, there remains a need for an inexpensive and effective refuse collection system.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects and briefly stated, the present invention is a method and system for compacting refuse in refuse containers such as roll off containers. As used herein, the term "roll off containers" refers to a refuse receptacle having an open top that is adapted to be carried by a vehicle, such as a truck, to a refuse disposal site. These receptacles are also referred to as "box rollers." The present system includes a forklift apparatus, which is used to engage a compaction weight. Once engaged, the compaction weight is placed over the open top of a roll off container including refuse. Next, the compaction weight is lowered into the container by the forklift so as to compact the refuse.

A feature of the present invention is the use of a compaction method and system, which includes the combination of a forklift apparatus and a compaction weight. Heretofore, forklifts have been used primarily to lift and transport objects. However, the present invention permits a forklift to be used for the additional task of compacting, which was previously beyond its applicability. Additionally, the combination of a forklift apparatus with a compaction weight provides a relatively simple and economic way of compacting refuse in a receptacle such as a roll off container. As discussed, refuse compactors such as packing rams tend to be both expensive and complex. Further, packing rams must be permanently fixed and occupy valuable docking space for loading and unloading freight. In the present invention, the compaction system is portable and is 75% less than the cost of hydraulic packing rams. Moreover, the compaction system does not require any complicated machinery or special operator skill to implement. Finally, the compaction system can be conveniently stored and transported.

Another feature of the present invention is the use of a compaction weight that is dimensioned to be engaged by a forklift apparatus. The particular dimensions of the compaction weight contribute to the ease and simplicity of the compaction method and system. Furthermore, safety features can be included to the compaction weight to ensure that the forklift apparatus safely and effectively compacts the refuse in a receptacle without misplacing or dropping the weight during compaction.

Yet another feature of the present invention is the use of a compaction weight that is dimensioned to be received by a roll off container. The dimensions of the compaction weight can be particularly suited for compacting refuse within the roll off container. Therefore, the refuse can be most effectively and efficiently compacted without the need for multiple or complex compacting steps.

Other features and advantages of the present invention will be apparent to those skilled in the art from a careful reading of the Detailed Description of the Invention presented below and accompanied by the drawings.

DETAILED DESCRIPTION OF THE INVENTION

Figure 1:
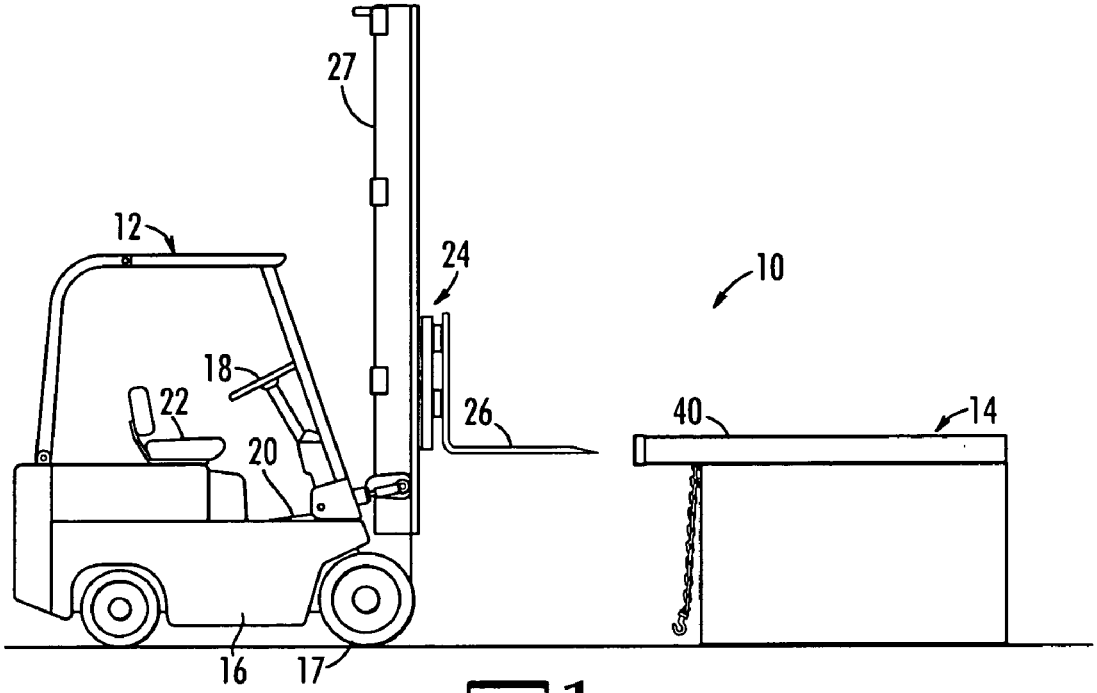
FIG. 1 is a side elevational view of a forklift apparatus and a compaction weight of a compaction system according to a first embodiment of the present invention.
Figure 2:
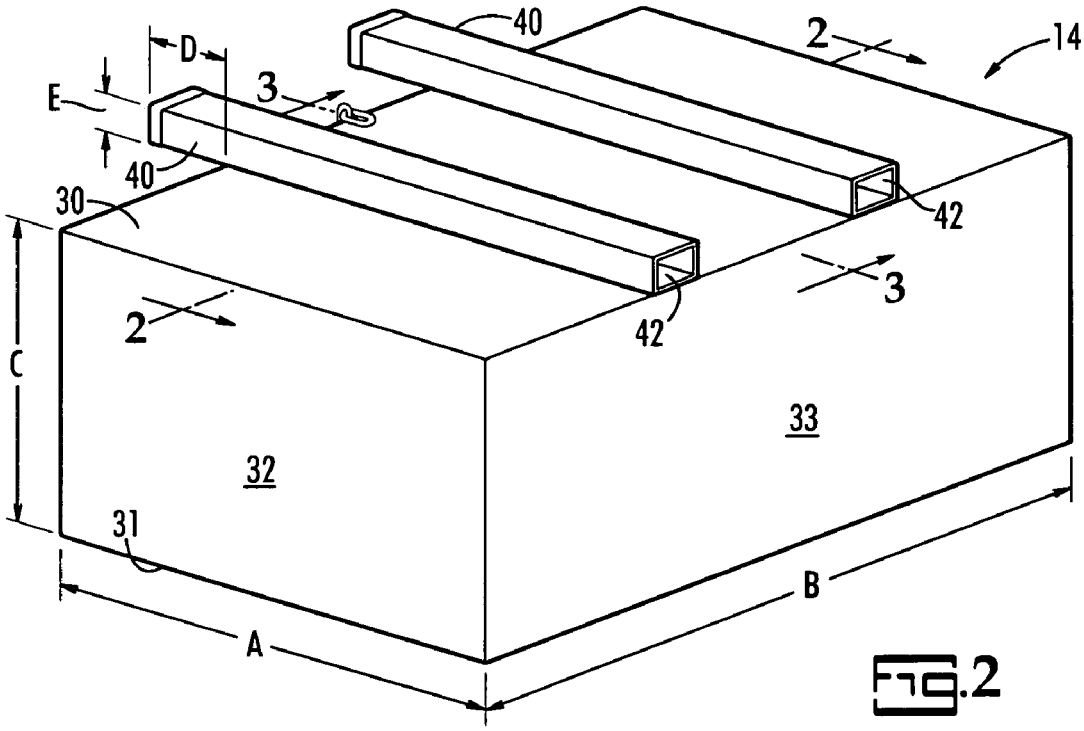
FIG. 2 is a perspective view of a compaction weight according to a first embodiment of the present invention.
Figure 3:
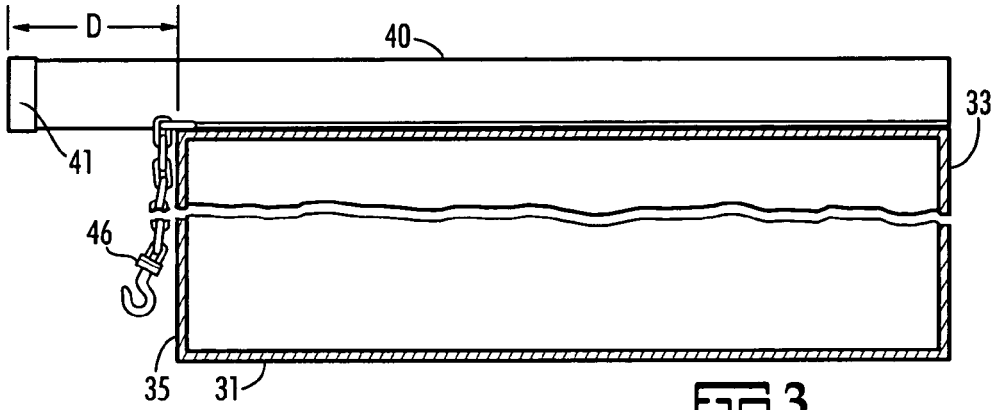
FIG. 3 is a side cross sectional view taken at Line 3—3 of FIG. 2 of a compaction weight according to a first embodiment of the present invention.

Referring now to FIG. 1, there is shown a compaction system 10 of the present invention. As illustrated, the compaction system 10 includes a forklift apparatus 12 and a compaction weight 14. The particular features of the forklift apparatus 12 are not critical. Generally, the forklift apparatus 12 can include a conventional forklift chassis 16 including a frame being conventionally mounted upon a wheel assembly including axle members (not shown) and wheel members 17. A conventional drive assembly is conventionally mounted to the conventional forklift chassis 16 and includes a steering mechanism 18 and a foot pedal 20 being functionally and conventionally positioned at the front end of the forklift chassis 16. Forklift apparatus 12 further includes a seat 22 for a forklift operator. Finally, a conventional lift assembly 24 including a plurality of lifting tines 26 is movably and conventionally mounted upon a mast 27 located at the front end of the forklift chassis 16.

The compaction weight 14 of the present invention is shown in detail in FIGS. 2–5. As illustrated, the compaction weight 14 generally has a box-like shape including a top surface 30 and an opposing bottom surface 31, which are connected along the edges by side walls, 32, 33, 34, 35 perpendicular to the top surface 30 and bottom surface 31. Although no particular material is required for the construction of the compaction weight, preferably, the weight is made of a type of metal suitable for industrial applications, such as steel. The dimensions of the compaction weight 14 can also vary; however, the dimensions can include a width A of about 5 feet, a length B of about 8 feet, and a height C of about 3 feet.

On the top surface 30, the compaction weight 14 carries means for engaging 40 forklift tines 26 such as channels 40. Channels 40 are dimensioned to receive the tines 26 whereby the tines 26 are inserted into plural apertures 42. As shown, the channels 40 can extend from the edge of side wall 33 to beyond the edge of side wall 35. In particular, at the end of the channels 40 that will receive the forklift tines 26 during operation, the channels 40 can extend beyond the side wall 35 a length D. Length D can be any length that provides sufficient clearance between the forklift 12 and the refuse container during operation. With the dimensions described above for the compaction weight, Length D can be about 12 inches. Additionally, each of the channels 40 can include a wrap 41 along the edge of the channels 40, that can include about a quarter inch wide strip of steel. This wrap 41 can further enhance the safety of the compaction system 10 during the operation and handling of the weight 14.

Figure 4A:
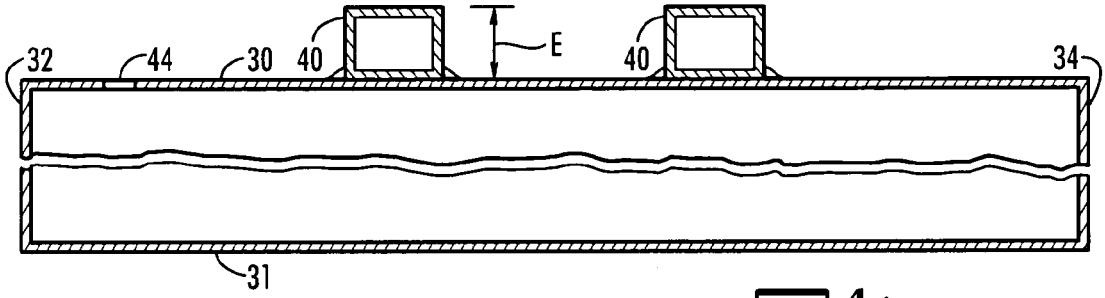
FIG. 4A is a front cross sectional view taken at Line 2—2 of FIG. 2 of a compaction weight according to a first embodiment of the present invention.
Figure 4B:
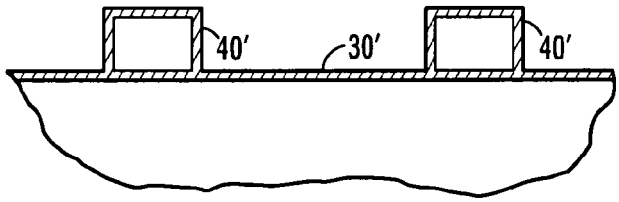
FIG. 4B is a detailed cross sectional view of the tine-receiving channels, according to an alternative embodiment of the present invention.

Although channels 40 are shown in FIG. 4A as being carried on the top surface 30 such as by welding; alternatively, channels 40' could be formed integrally with the top surface 30', as shown in FIG. 4B. Further, the channels 40 can include a height E that is sufficient to avoid teetering of the compaction weight 14 when it is engaged with the forklift tines 26. Height E can be about 4 inches, but can vary depending on the dimensions of the tines 26. What is also important to the practice of the invention is that the apertures in channels 40 be dimensioned and formed to receive tines 26 so as to engage and support the compaction weight 14.

Figure 5:
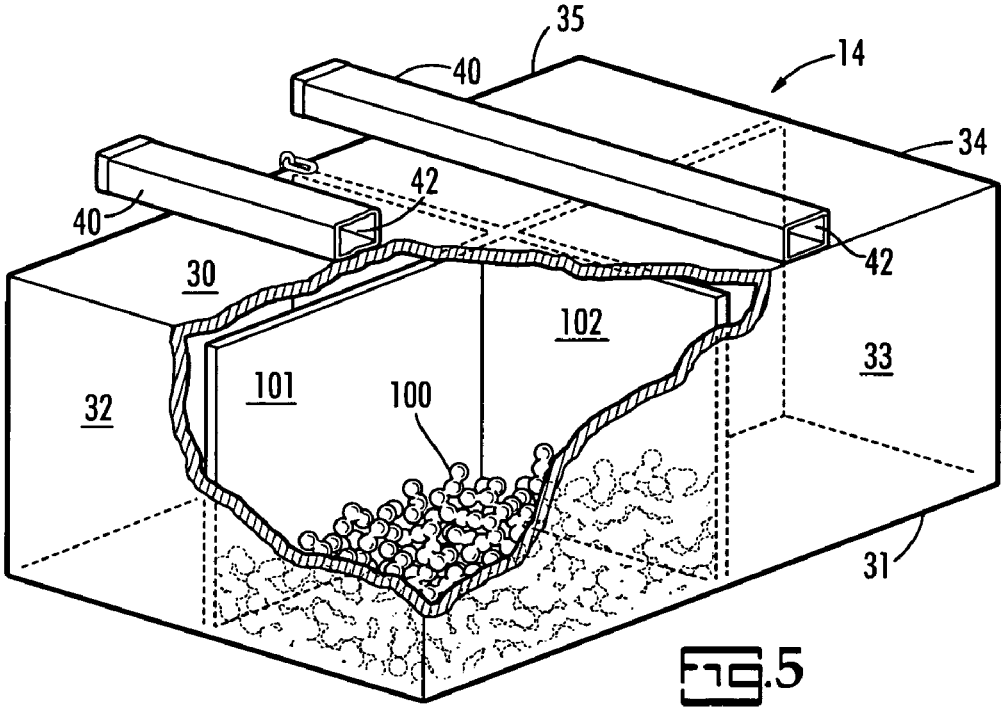
FIG. 5 is a perspective, partial cutaway view of a compaction weight and its contents according to a first embodiment of the present invention.
Figure 5A:
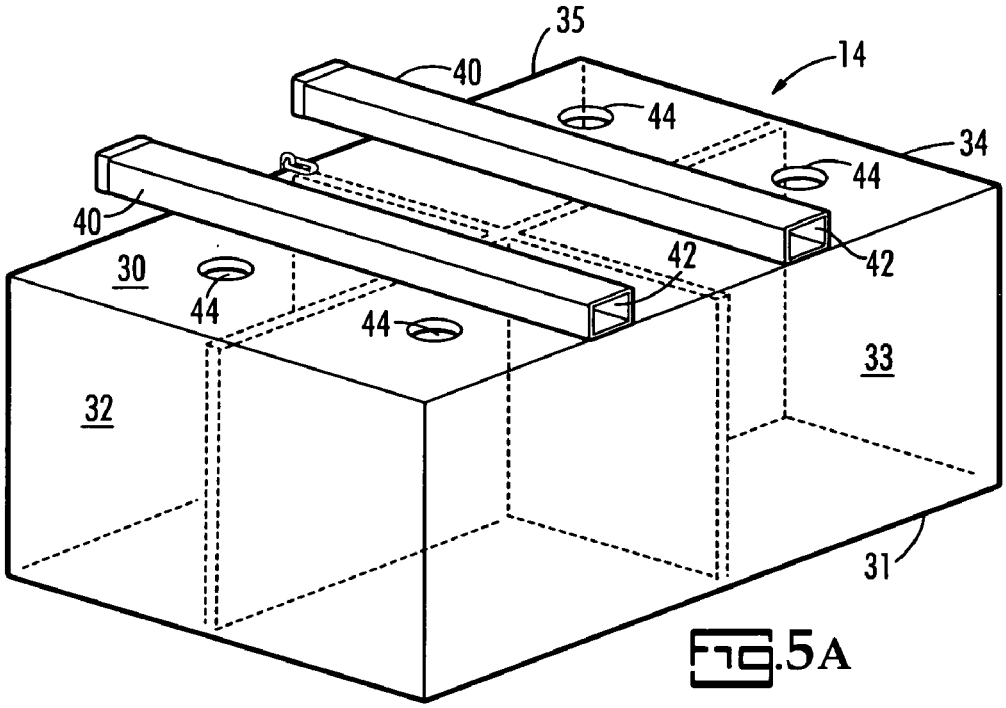
FIG. 5A is a perspective view of a compaction weight according to an alternative embodiment of the present invention.

As shown in FIG. 5, within its outer surfaces, the compaction weight 14 is hollow and adapted to receive a mass 100 to add the sufficient amount of weight for the practice of the present compaction method. For example, the compaction weight 14 can include plated steel, as well as crushed asphalt or cement, slag (a byproduct of steel), or recycled concrete. If crushed rocks of slag are used as the mass 100, these rocks can be of different, non-uniform sizes. Additionally, the compaction weight 14 can include a flowable mass, such as sand. The particular material that is included within the weight 14 will depend on both the types of refuse being compacted, as well as the lifting power of forklift apparatus 10 employed. It is important that the material be about moisture-free or contain about 0% water, so as to avoid any corrosion of the compaction weight 14. In making the compaction weight, the top surface 30 of the weight can be welded onto the weight after the weight 14 is appropriately filled with mass. Alternatively, as shown if FIG. 5A, the compaction weight 14 can include an inlet or port 44 that can receive flowable mass. Although the weight of the mass 100 can vary, it is preferably at least about 3000 pounds, and can include additional weights increasing in about 500 pound increments, such as about 3500 pounds, about 4000 pounds, about 4500 pounds, about 5000 pounds, about 5500 pounds, and about 6000 pounds.

As further illustrated in FIG. 5, the compaction weight can include intersecting, inner walls 101 and 102 within the interior space of the compaction weight 14. These inner walls 101, 102 can facilitate in maintaining the uniformity and consistency of the mass 100 as it resides within the compaction weight 14. In particular, the inner walls 101, 102 can be about perpendicular to each other, wherein inner wall 101 can extend from side walls 32 and 34, and wherein inner wall 102 can extend from sidewalls 35 and 33 so as to form four distinct sections within the compaction weight 14 that are about box-shaped. Further, there can be about the same amount of mass 100 in each of these four distinct sections. These inner walls 101, 102 can be welded to the interior of the outer walls of the compaction weight 14, and can therefore also serve to strengthen the outer walls.

A particular feature of the present invention is the use of a compaction method and system, which includes the combination of the forklift apparatus 12 and the compaction weight 14. Heretofore, forklifts have been used primarily to lift and transport objects. However, the present invention permits a forklift to be used for the additional task of compacting, which was previously beyond its applicability. Additionally, the combination of forklift apparatus 12 with compaction weight 14 provides a relatively simple and economic way of compacting refuse in a receptacle such as a roll off container. Refuse compactors such as packing rams tend to be expensive, complex, and they require significant maintenance. Further, packing rams require a supply of electrical power and must be attached or anchored to the ground. The compaction system 10 of the present invention, therefore, is advantageous because it is mobile, can be used on multiple roll off containers, and can be stored out of the way when not in use. No power is required, and no maintenance is needed for the present compaction system 10. Moreover, the compaction system 10 does not require any complicated machinery or special operator skill to implement.

Figure 6:
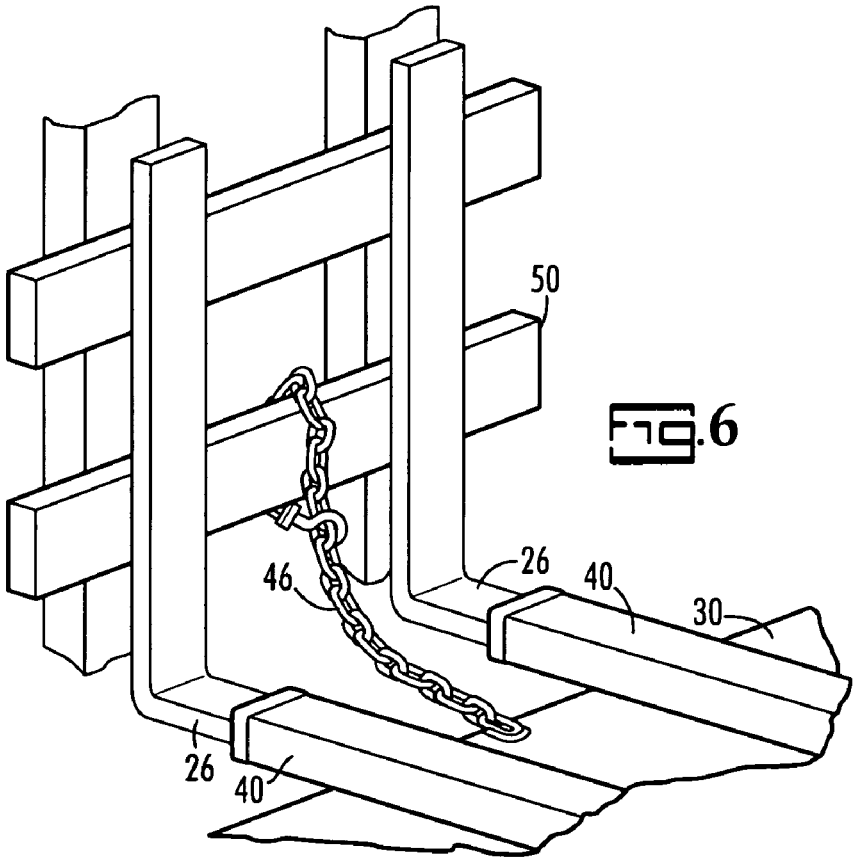
FIG. 6 is a perspective view of a safety feature of a compaction system according to a first embodiment of the present invention.
Figure 7A:
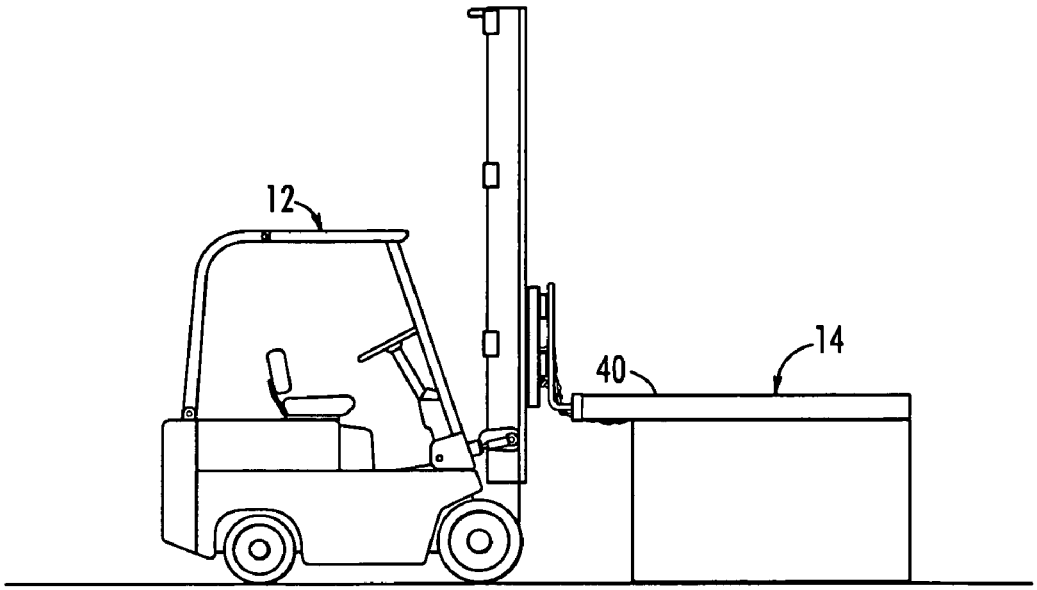
FIG. 7A is a side elevational view of a forklift apparatus and a compaction weight of a compaction system, with tines inserted in the channels of the compaction weight, according to a first embodiment of the present invention.
Figure 7B:
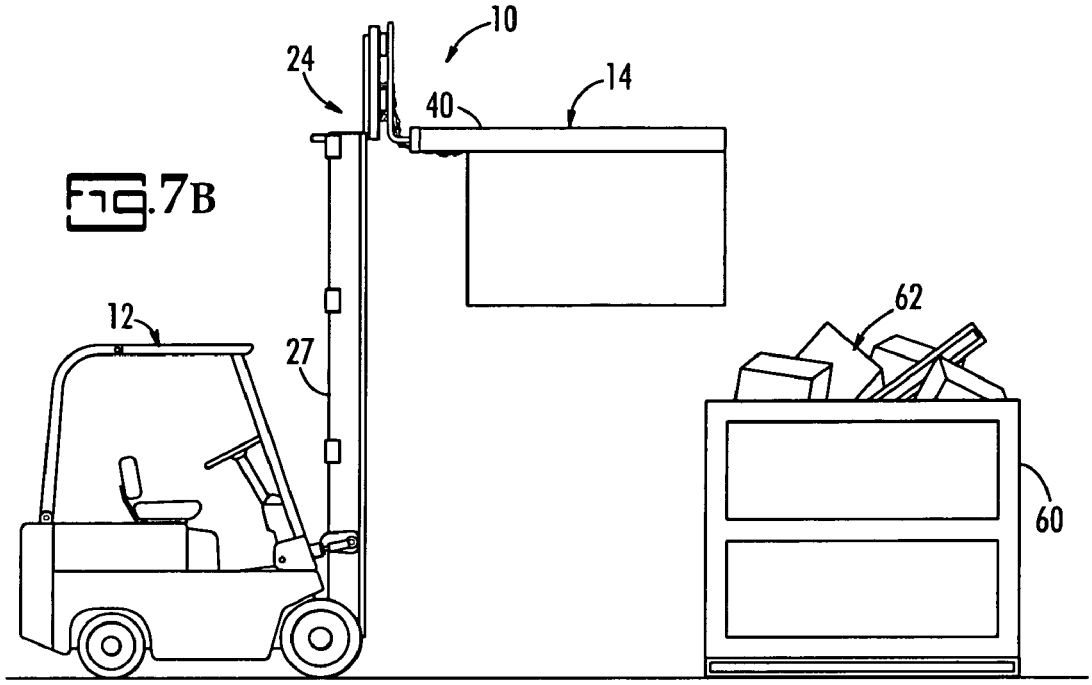
FIG. 7B is a side elevational view of a compaction system and a refuse receptacle, with compaction weight shown lifted by fork lift, according to a first embodiment of the present invention.
Figure 7C:
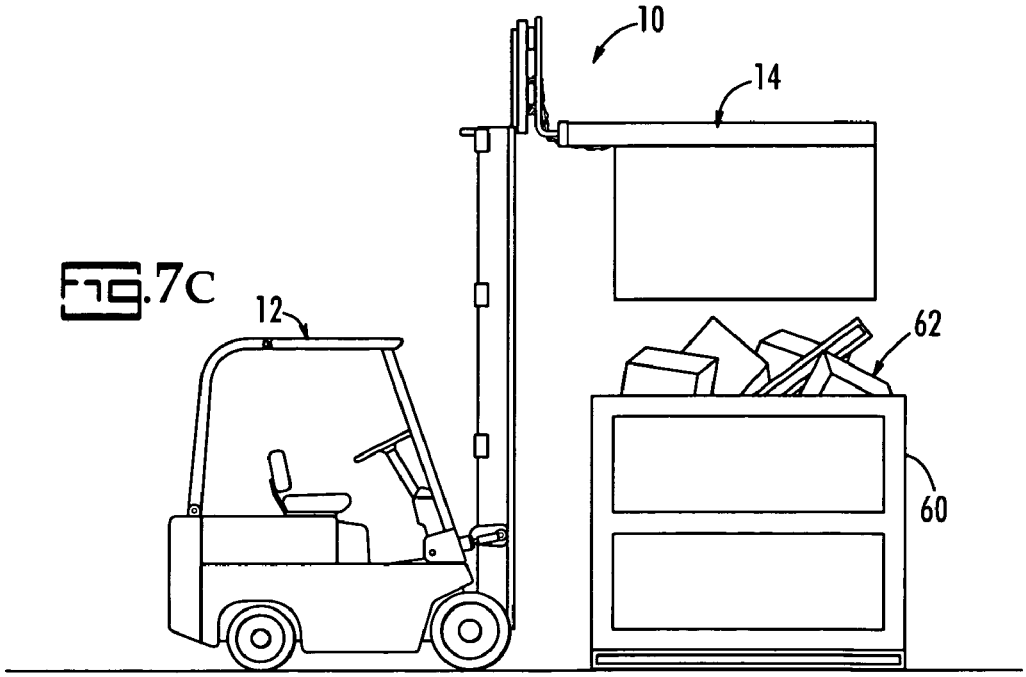
FIG. 7C is a side elevational view of a compaction system and a refuse receptacle, with lifted compaction weight poised over refuse receptacle, according to a first embodiment of the present invention.
Figure 7D:
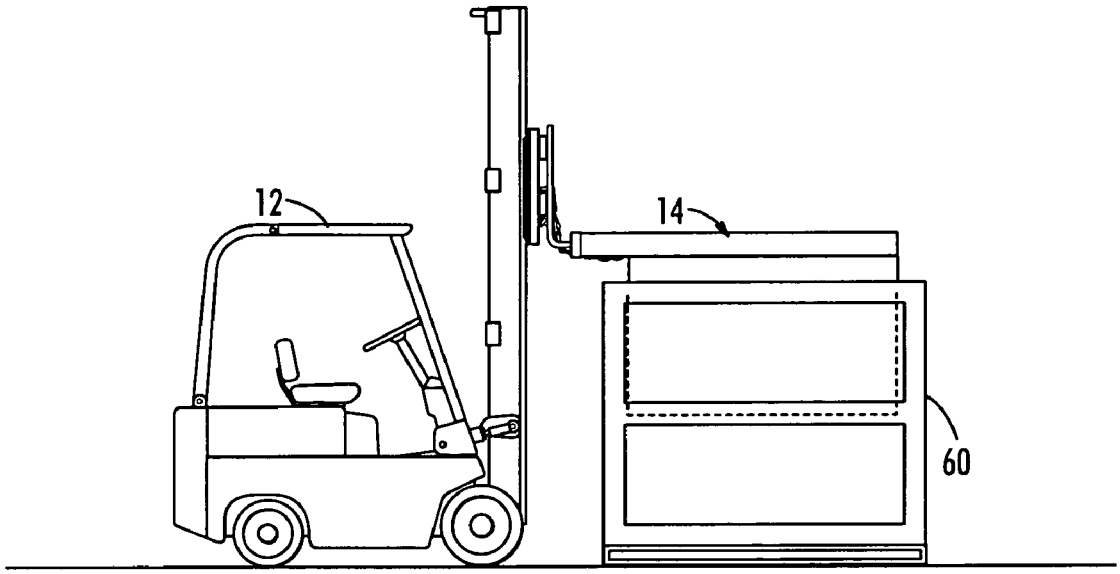
FIG. 7D is a side elevational view of a compaction system with a refuse receptacle shown during compaction according to a first embodiment of the present invention.
Figure 7E:
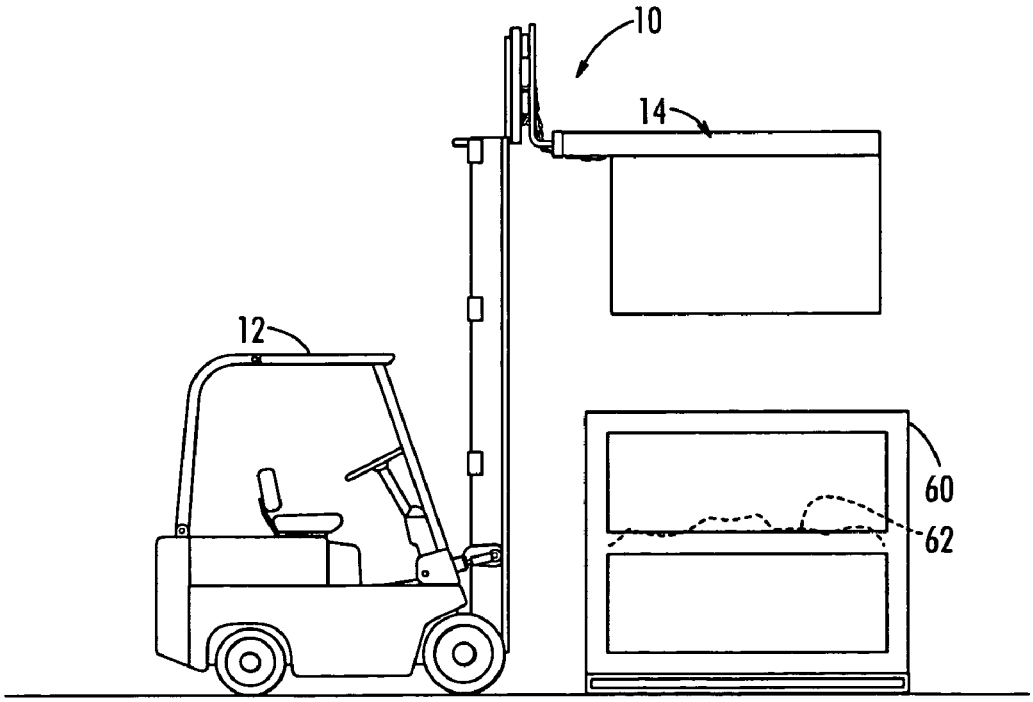
FIG. 7E is a side elevational view of a compaction system with a refuse receptacle shown after compaction according to a first embodiment of the present invention.

As shown in FIG. 6, the compaction weight 14 of the present invention can also include means for securing compaction weight 14 to forklift apparatus 10, such as a cable or a chain 46. Chain 46 adds a safety feature to the compaction system 10, because it ensures that compaction weight 14 remains engaged to the forklift apparatus 12 during operation.

As previously discussed, another feature of the present invention is the use of compaction weight 14 dimensioned to be engaged by forklift apparatus 12. The particular dimensions of the compaction weight 14 contribute to the ease and simplicity of the compaction method and system. Furthermore, the use of the chain 46 contributes to the safe and effective compacting of refuse in a receptacle, and minimizes the concern of misplacing or dropping the weight 14 during compaction. Moreover, the chain 46 can serve as a gauge to show that the tines are in place and properly inserted, and can be about 42 inches in length.

In use, as shown in FIG. 6, the chain 46 is wrapped around a rigid member that forms part of the forklift apparatus 12 such as a tine support 50. Further, FIG. 6 shows how the tines 26 of the forklift apparatus 12 fit telescopically within the channels 40 to provide a secure and effective hold on the compaction weight 14.

Figure 8:
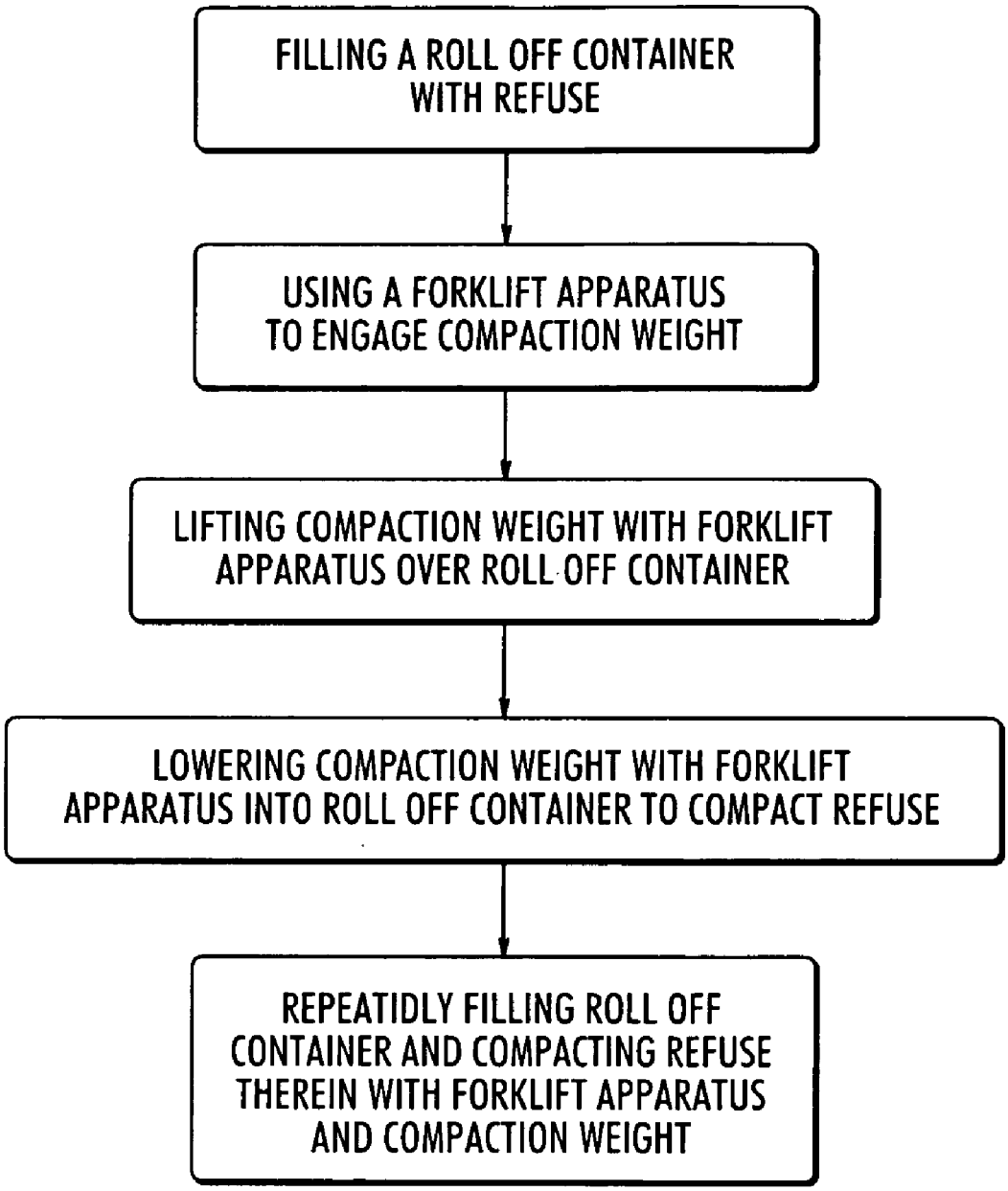
FIG. 8 is a flow chart of a process according to a first embodiment of the present method.

FIGS. 7A–7E illustrate the compaction method of the present invention, and FIG. 8 provides a flow chart summarizing this process. As shown, the forklift apparatus 12 engages the compaction weight 14. In particular, the tines 26 of the forklift apparatus 12 are lifted by the forklift operator to an elevation that is level with the channels 40 of the compaction weight 14. Next, the tines 26 are inserted into the apertures 42 of the engaging means 40. The chain 46 is thereafter attached to the forklift apparatus 12.

Once the compaction weight 14 has been effectively secured to the forklift apparatus 12, the lift assembly 24 operates to lift the compaction weight 14 to an elevation that will be sufficient to clear the top edge of an open top, roll off container 60. The compaction weight 14 is next brought forward by the forklift apparatus 12 so that the compaction weight 14 is directly above refuse 62 contained by the roll off container 60. To compact the refuse, the compaction weight 14 is simply lowered into the roll off container 60. Finally, the compaction weight 14 is lifted and removed by the forklift apparatus 12 leaving behind a compacted roll off container 60. Thereafter, additional refuse 62 can be added to the roll off container 60, and the compacting steps can be repeated until the roll off container 60 is filled with compacted refuse.

What is particularly significant to the practice of the present invention is the use of open top, roll off containers 60. As previously described, there are two main forms of refuse collection systems: one involves the use of roll-off containers, whereby the containers themselves are transported offsite and emptied of refuse at a disposal site; and the other involves the use of front-end load containers, whereby the containers full of refuse are emptied onsite by a refuse collection vehicle and thereafter the refuse itself is transported to a disposal site. As used herein "roll off containers" include containers for collecting refuse that have an open top and that can be engaged along the bottom by a transport vehicle.

Figure 9:
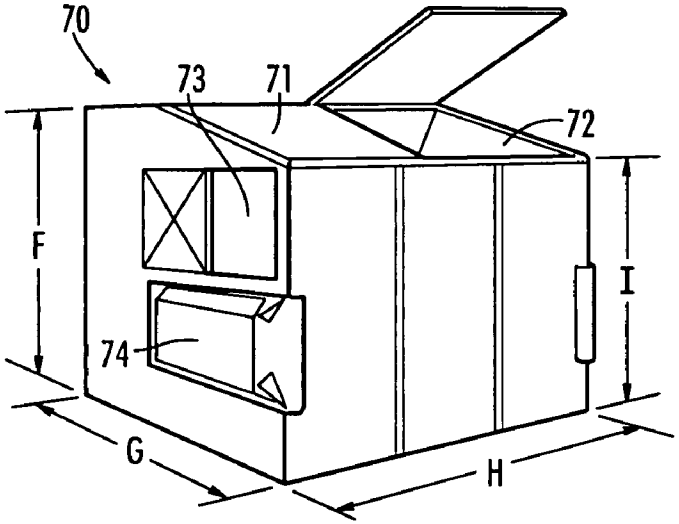
FIG. 9 are perspective views of prior art front-end load containers.
Figure 10:
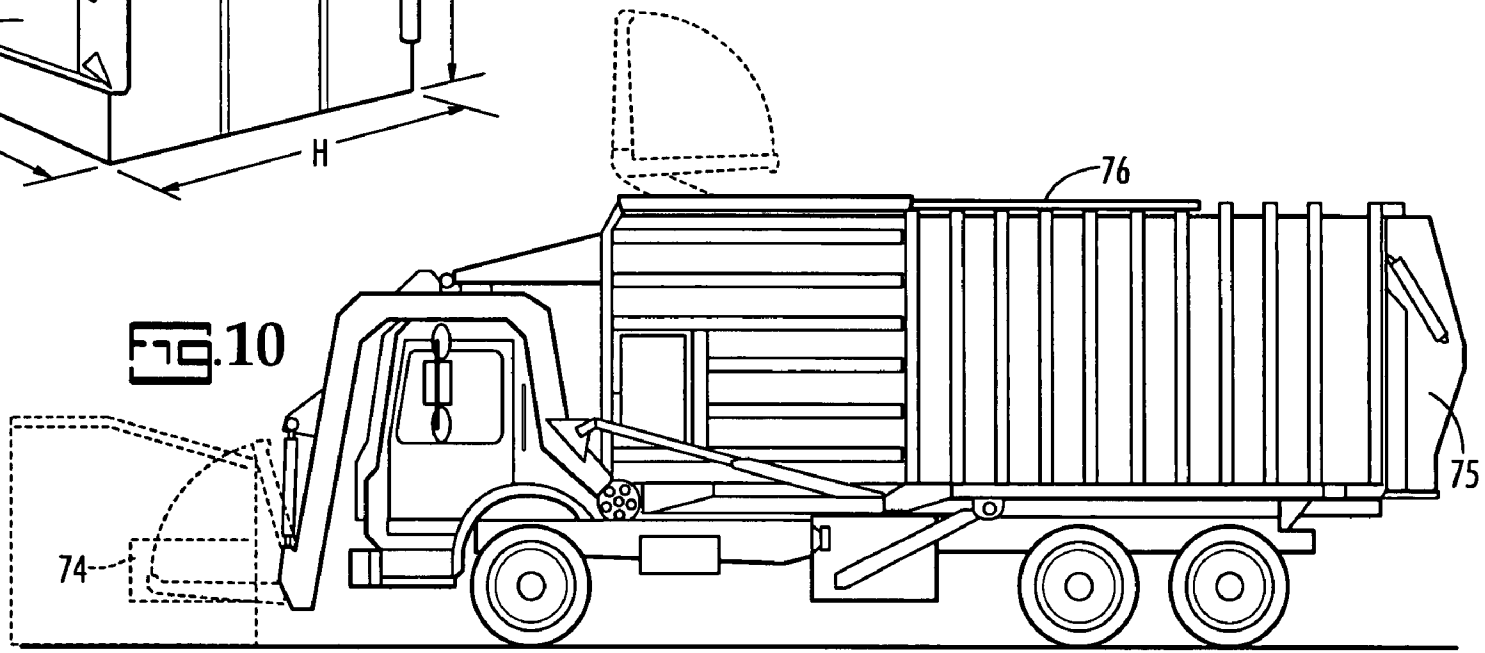
FIG. 10 is side view of a prior art compaction system employing front-end load containers.
Figure 11B:
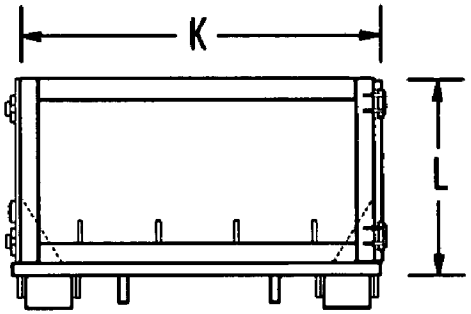
FIG. 11B is a front view of a standard roll off container according to a first embodiment of the present invention.
Figure 12B:
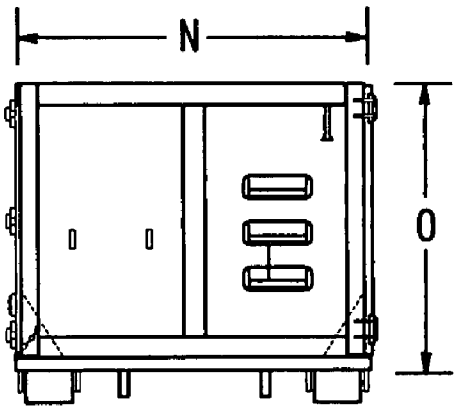
FIG. 12B is a front view of a standard roll off container according to a first embodiment of the present invention.
Figure 11A:
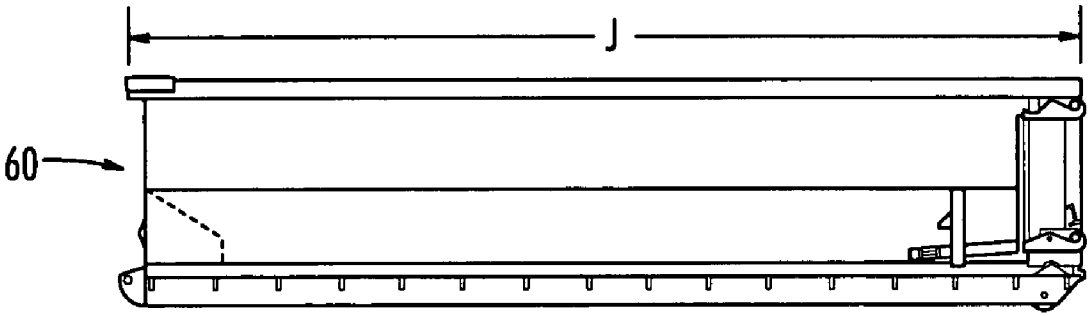
FIG. 11A is a side view of a standard roll off container according to a first embodiment of the present invention.
Figure 12A:
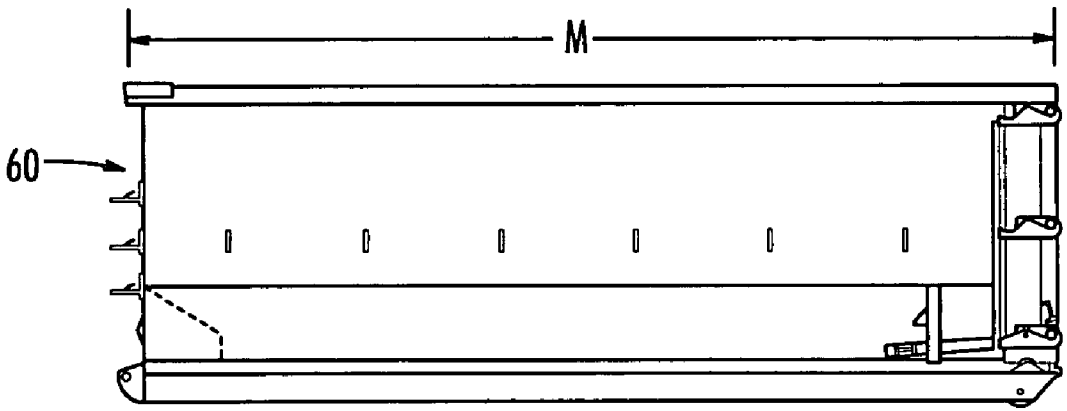
FIG. 12A is a side view of a standard roll off container according to a first embodiment of the present invention.

Roll off containers 60 can be distinguished from a front-end load container 70, as shown in FIG. 9. These containers are much smaller and include different features than roll off containers 60, shown in FIGS. 11A–12B. In particular, a typical front end load container 70 includes a slanted top 71 that includes an opening 72 where refuse can be either put in or taken out of the container 71. Optionally, there is also a side opening 73. Front-end load containers 70 are specifically dimensioned to be lifted and emptied by a collection vehicle 75, as shown in FIG. 10, and therefore also include means for engaging 74 along the side walls. Specifically, the collection vehicle 75 will drive onsite to the location of the front-end load container 70, lift the container 70 through the use of engaging means 74 so as to dump the contents of the container 70 into the collection vehicle bed 76. Most of these types of collection vehicles also contain hydraulic rams within their beds to compact the refuse. The dimensions of front-end load containers are standard and include a back height F of between 3'5" to 6'1½", a front height H of between 3' to 6', a length G of between 3' to 6'8", and a width H of 6'.

Standard roll off containers 60 are shown in FIGS. 11A–12B. The term "standard roll off containers" refers to those roll off containers having dimensioned that conform to the most widely used roll off containers in the refuse collection industry. Although these standard roll off containers 60 are provided in three sizes, only two sizes are shown. In FIGS. 11A–12B, a standard roll off container 60 capable of handling 20 yards of volume refuse is shown. With this capacity, the roll off container 60 includes a length J of 20 feet, a height L of 4 feet and 2 inches, and a width K of 7 feet 11 inches. A standard roll off container 60 capable of handling 30 yards of volume of refuse is shown in FIGS.

12A–12B. With this capacity, the roll off container 60 includes a length M of 20 feet, a height O of 6 feet and two inches, and a width N of 7 feet 11 inches. The third size of standard roll off containers is capable of handling 40 yards of volume of refuse, and includes a length of 22 feet, a height of 7 feet 5 inches, and a width of 7 feet 11 inches.

Because of these standard dimensions, the dimensions and features of the compaction weight 14 can also be significant. With the particular size and weight of the compaction weight 14, it is ideal for use with open top, roll off containers. The width of the compaction weight is preferably less than 7 feet 11 inches. The use of a width of about 5 feet can be useful in effective compacting, as it provides sufficient room or space to maneuver and compact the refuse. The use of a compaction weight length of about 8 feet can also be useful in terms of maneuverability by the forklift of the weight during the compaction.

Figure 13:
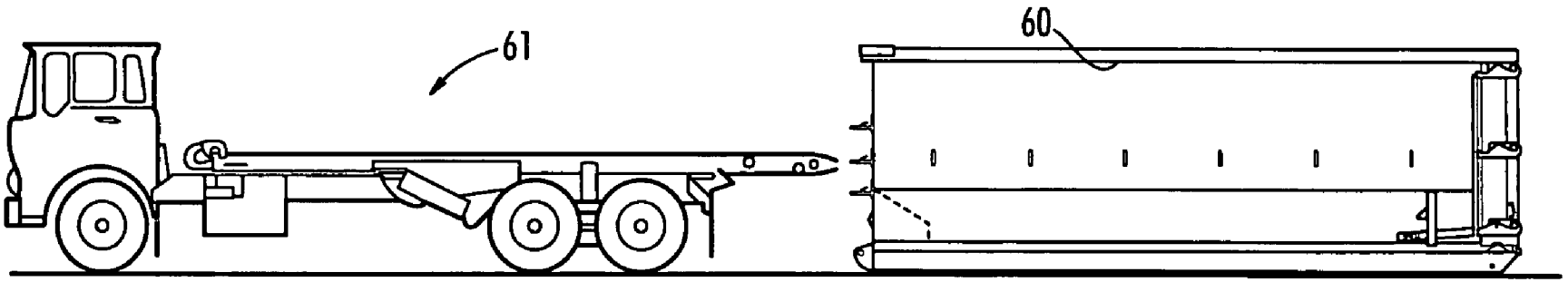
FIG. 13 is a side view of a vehicle equipped to carry a standard roll off container according to a first embodiment of the present invention.

In operation, the standard roll off container 60 is assembled with a transport vehicle 61, as shown in FIG. 13. In particular, the roll off container 60 is engaged from the bottom of the roll off container 60. To engage the roll off container 60, the truck is backed up to one end of the roll off container 60. Thereafter, a hooking means, such as a cable is attached to the roll off container, which is then "rolled" onto the back of the truck. The same technique is used to disengage the roll off container 60. During the compaction method of the present invention, it is understood that the refuse will be compacted while the container is off of the truck.

It will be apparent to those skilled in the art that many changes and substitutions can be made to the preferred embodiment herein described with departing from the spirit and scope of the present invention as defined by the appended claims.

What is claimed is:

1. A compaction system, comprising:

a forklift apparatus having a plurality of tines;

a compaction weight, wherein said compaction weight has means for engaging said plurality of tines so that said forklift apparatus can lift said compaction weight, and wherein said compaction weight is a box having an interior space, and includes a top surface, an opposing bottom surface, a first side wall, a second side wall opposing said first side wall, a third side wall, and a fourth side wall opposing said third side wall, wherein each of said first, second, third, and fourth side walls is perpendicular to said top surface and said bottom surface and connect said top surface and said bottom surface, said engaging means is carried on top of said top surface, said compacting weight further includes a first inner wall that intersects with a second inner wall, said first inner wall being perpendicular to said second inner wall, wherein said first inner wall is connected to said first side wall and said second side wall, and wherein said second inner wall is connected to said third side wall and said fourth side wall, said first and second inner walls forming four interior sections; and a mass contained in said interior section of said compacting weight, and said compacting weight includes at least one inlet for receiving said mass.

2. The compaction system as recited in claim 1, wherein said engaging means is dimensioned to receive said plurality of tines.

3. The compaction system as recited in claim 2, wherein said engaging means includes a first channel and a second channel.

4. The compaction system as recited in claim 3, wherein each of said first and second channels has a height E of about 4 inches.

5. The compaction system as recited in claim 3, wherein each of said first and second channels extends along said top surface from said first side wall to said second side wall.

6. The compaction system as recited in claim 5, wherein each of said first and second channels extends beyond the edge of said first wall by a length D.

7. The compaction system as recited in claim 6, wherein said length D is about 12 inches.

8. The compaction system as recited in claim 3, wherein each of said first and second channels includes a channel wrap.

9. The compaction system as recited in claim 1, wherein each of said four interior sections contains about the same amount of said mass.

10. The compaction system as recited in claim 1, wherein said mass is a plurality of slag rocks.

11. The compaction system as recited in claim 1, wherein said mass has about 0% moisture.

12. The compaction system as recited in claim 1, wherein said mass is at least about 3000 pounds.

13. The compaction system as recited in claim 1, wherein said mass is about 3500 lbs., about 4000 lbs., about 4500 lbs., about 5000 lbs., about 5500 lbs., or about 6000 lbs.

14. The compaction system as recited in claim 1, wherein said compaction weight has a width A of about 5 feet, a length B of about 8 feet, and a height C of about 3 feet.

15. The compaction system as recited in claim 1, wherein said engaging means is formed integrally with said top surface.

16. The compaction system as recited in claim 1, further comprising means for securing said compaction weight to said forklift apparatus.

17. A compaction system, comprising:

a forklift apparatus having a plurality of tines;

a compaction weight having means for engaging said plurality of tines so that said forklift apparatus can lift said compaction weight, and wherein said compaction weight is a box having an interior space, and includes a top surface, an opposing bottom surface, a first side wall, a second side wall opposing said first side wall, a third side wall, and a fourth side wall opposing said third side wall, wherein each of said first, second, third, and fourth side walls is perpendicular to said top surface and said bottom surface and connect said top surface and said bottom surface said engaging means is carried on top of said top surface, said compacting weight further includes a first inner wall that intersects with a second inner wall, said first inner wall being perpendicular to said second inner wall, wherein said first inner wall is connected to said first side wall and said second side wall, and wherein said second inner wall is connected to said third side wall and said fourth side wall, said first and second inner walls forming four interior sections;

a standard roll off container, wherein said compaction weight is dimensioned to be received by said roll off container; and a mass contained in said interior section of said compacting weight, and said compacting weight includes at least one inlet for receiving said mass.

18. The compaction system as recited in claim 17, wherein said standard roll off container has a length of 20 feet, a width of 7 feet 11 inches, and a height of 4 feet 2 inches.

19. The compaction system as recited in claim 17, wherein said standard roll off container has a length of 20 feet, a width of 7 feet 11 inches, and a height of 6 feet 2 inches.

20. The compaction system as recited in claim 17, wherein said standard roll off container has a length of 22 feet, a width of 7 feet 11 inches, and a height of 7 feet 5 inches.

21. A method for compacting refuse within a roll off container, comprising the steps of:

providing a roll off container with an open top;

placing refuse in said roll off container;

providing a forklift apparatus having a plurality of tines;

providing a compaction weight having channels formed therein, said compacting weight is a box having an interior space, and includes a top surface, an opposing bottom surface, a first side wall, a second side wall opposing said first side wall, a third side wall, and a fourth side wall opposing said third side wall, wherein each of said first, second, third, and fourth side walls is perpendicular to said top surface and said bottom surface and connect said top surface and said bottom surface, said channels extend along a top of said top surface, said compacting weight further includes a first inner wall that intersects with a second inner wall, said first inner wall being perpendicular to said second inner wall, wherein said first inner wall is connected to said first side wall and said second side wall, wherein said second inner wall is connected to said third side wall and said fourth side wall, said first and second inner walls forming four interior sections, a mass contained in said interior sections of said compacting weight, and said compacting weight includes at least one inlet for receiving said mass;

elevating said plurality of tines to the same elevation of said channels;

inserting said plurality of tines within said channels;

elevating said compaction weight with said forklift apparatus to an elevation that is above the top edge of a roll off container;

moving said compaction weight with said forklift apparatus over said roll off container; and lowering said compaction weight with said forklift apparatus onto said refuse in said roll off container to compact said refuse.

22. The method for compacting as recited in claim 21, further comprising the step of securing said compaction weight to said forklift apparatus.

23. The method for compacting as recited in claim 21, further comprising the steps of:

elevating said compaction weight with said forklift apparatus after said lowering step;

filling said compacted roll off container with additional refuse; and repeating said lowering steps to compact said additional refuse.

* * * * *